US007384509B2

(12) United States Patent
Heikkinen et al.

(10) Patent No.: US 7,384,509 B2
(45) Date of Patent: Jun. 10, 2008

(54) METHOD FOR CONTROLLING THE MOISTURE PROFILE OF A PAPER WEB

(75) Inventors: Antti Heikkinen, Helsinki (FI); Heikki Kettunen, Espoo (FI); Hannu Lätti, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 444 days.

(21) Appl. No.: 10/502,859

(22) PCT Filed: Feb. 5, 2003

(86) PCT No.: PCT/FI03/00091

§ 371 (c)(1),
(2), (4) Date: Mar. 8, 2005

(87) PCT Pub. No.: WO03/069060

PCT Pub. Date: Aug. 21, 2003

(65) Prior Publication Data

US 2005/0145356 A1 Jul. 7, 2005

(30) Foreign Application Priority Data

Feb. 13, 2002 (FI) ..... 20020287

(51) Int. Cl.
*D21F 11/00* (2006.01)

(52) U.S. Cl. ..... 162/198; 162/263; 162/199; 427/8; 427/366; 73/159; 34/446; 34/444

(58) Field of Classification Search ..... 162/198, 162/263; 427/8, 366; 73/159, 864.451; 34/446, 444, 445

See application file for complete search history.

(56) References Cited

U.S. PATENT DOCUMENTS

| | | | | |
|---|---|---|---|---|
| 5,045,342 | A | 9/1991 | Boissevain et al. | |
| 5,429,303 | A | 7/1995 | Winheim | |
| 5,445,071 | A | 8/1995 | Winheim | |
| 5,649,448 | A | 7/1997 | Koskimies et al. | |
| 6,584,703 | B1 * | 7/2003 | Maenpaa et al. | 34/446 |

FOREIGN PATENT DOCUMENTS

| | | |
|---|---|---|
| WO | WO 95/31602 | 11/1995 |

* cited by examiner

*Primary Examiner*—Mark Halpern
(74) *Attorney, Agent, or Firm*—Alston & Bird LLP

(57) ABSTRACT

A method for controlling the moisture profile of a paper web or board web processed in a heated multi-roll calendar to optimize the qualities of the paper or board, especially gloss. The method is characterized in that the moisture measurement is carried out both on either surface of the web and as a through-measurement, and the measurement results thus obtained are specified by a thermodynamic model which calculates the moisture of the web in three layers, and that the results thus obtained are used for controlling the supply of moisture to the web.

5 Claims, No Drawings

METHOD FOR CONTROLLING THE MOISTURE PROFILE OF A PAPER WEB

This is a 371 of PCT/FI03/00091 filed on 5 Feb. 2003.

BACKGROUND OF THE INVENTION

1. Field of the Invention

The invention relates to a method for controlling the moisture profile of a paper or board web processed on a heated multi-roll calender to optimize the qualities of the paper or board, especially gloss.

2. Description of Related Art

For controlling the gloss of a paper web, a gloss controller is known, the operating principle of which is as follows:

the gloss of the paper web is measured if the gloss is insufficient, steam is added steam is added until the gloss is as desired.

This type of gloss controller for a paper web moisturized on its surface cannot be used in connection with heated multi-roll calendars for the following reasons:

the derivative of the response function of steam changes from positive to negative at a certain steam level. That is, the response resembles a downwards opening second-order polynomial. In other words, following the addition of a certain amount of steam, the addition of steam in fact deteriorates the gloss of the paper web compared with the optimum amount of steam.

when gradient calendering in practical conditions, the body moisture and surface moisture of the paper vary. The response of steam is very dependent on the amount of the surface moisture.

The reason for the form of the steam response and the violent effect of moisture are the moisture gradients appearing in the direction of thickness of the paper. In an on-line process, and especially in gradient calendering, these are much greater than in conventional calendering. The appearance of gradients is also affected by higher than conventional process heats.

SUMMARY OF THE INVENTION

The aim of the invention is to provide a method in which the above-mentioned factors are taken into account when supplying moisture to the web to obtain optimum gloss.

The method according to the invention is characterized in that moisture measurement is carried out both on either surface of the web and as a through-measurement, and the measurement results thus obtained are specified by a thermodynamic model which calculates the moisture of the web in three layers, and that the results thus obtained are used for controlling the supply of moisture to the web.

Further preferable developments of the invention are disclosed in the dependent claims.

DETAILED DESCRIPTION OF THE INVENTION

The calender is controlled by a thermodynamic model, by which can be calculated:

the moisture of the paper at different points of the calender the moisture and amount of heat in the paper caused by the addition of steam 3-layer moisture gradient and thermal gradient.

Moisture measurement is carried out as scanning measurement over the total width of the web at the beginning and end of the measurement period. If necessary, to improve the predicting capacity of the model, moisture measurement may, in addition, be carried out as point measurement at desired points between the extreme points of the measurement period.

The moisture of the paper is calculated in three layers by the model. If the moisture of all layers is at target moisture, the quality of the paper is optimal. This is due to the fact that, in such a case, the gloss does not deteriorate substantially as a result of the drying or post-moisturization. The above phenomena also explain the form of the response of steam and moisture in general with respect to gloss.

The moisture of three layers is measured by two surface meters and by a through-measurement. The through-measurement gives the average moisture after calendering and the surface measurements give the ratio between the surfaces. The measurement is specified by the model and the result is changed to three layers.

The method is preferably used for paper grades or board grades, the surface of which compresses more during calendering than the central part. The method is particularly suitable for gradient calendering, where the main principle is that the paper is wetted only on the surface and not throughout the thickness of the entire web. The fibers on the surface of the paper are arranged more uniformly in the hot calender nip due to the effect of moisture, pressure and heat, while the central part of the paper remains as it was before entering the calender nip. The inside of the web is dry enough to recover after the nip, whereas the moist and hot surface is in more plastic form and is thus deformed.

By the model, steam is added so that following the calender, the moisture gradient is even in the direction of thickness of the web or otherwise as desired. Thus, each steam pipe can be adjusted to provide only the required—and thus simultaneously the optimum—amount of steam.

The method can be used in both on-line and off-line calendars.

The method is preferably used for supercalendered (SC) paper.

That which is claimed:

1. A method for controlling a moisture profile of at least one of a paper web and a board web, having opposed surfaces and processed in at least one of an on-line and an off-line heated multi-roll calendar, so as to optimize a gloss quality thereof, comprising:

measuring moisture on each of the opposed surface of the web and as a through-measurement of the interior of the web between the surfaces thereof;

modeling the three measurements with a thermodynamic model for calculating the moisture of the web in three layers; and controlling a supply of moisture to the web, in response to the calculated three layer moisture model of the web, so as to control the moisture profile of the web between and including the opposed surfaces to thereby optimize the gloss quality of the web.

2. A method as claimed in claim 1, wherein measuring moisture further comprises measuring moisture on each surface through a scanning measurement over a width of the web at a beginning and an end of a measurement period.

3. A method as claimed in claim 2, wherein measuring moisture further comprises measuring moisture on each surface through a point measurement at a desired point about the measurement period.

4. A method as claimed in claim 1, wherein measuring moisture further comprises measuring moisture on each of the opposed surface of the web and as a through-measurement of the interior of the web, the web being one of a paper grade web and a board grade web wherein the surfaces are more compressible during calendering than the interior.

5. A method as claimed in claim 1, wherein measuring moisture further comprises measuring moisture on each of the opposed surface of the web and as a through-measurement of the interior of the web, the web being a supercalendered paper web.

* * * * *